United States Patent [19]

Mellinger

[11] 4,269,125

[45] May 26, 1981

[54] PULVERIZER REJECTS DISPOSAL

[75] Inventor: Gerald A. Mellinger, Bloomfield, Conn.

[73] Assignee: Combustion Engineering, Inc., Windsor, Conn.

[21] Appl. No.: 61,325

[22] Filed: Jul. 27, 1979

[51] Int. Cl.[3] ..... F23J 1/02

[52] U.S. Cl. ..... 110/171; 110/347

[58] Field of Search ..... 110/347, 342, 106, 105 A, 110/171

[56] References Cited

U.S. PATENT DOCUMENTS

| | | | |
|---|---|---|---|
| 3,223,074 | 12/1965 | Tanner et al. | 122/2 |
| 3,229,651 | 1/1966 | Wasp | 110/347 |
| 3,857,344 | 12/1974 | Coulter | 110/171 |
| 3,915,105 | 10/1975 | Michelbrink | 110/171 |
| 4,112,856 | 9/1978 | Fuhrman et al. | 110/171 |
| 4,146,359 | 3/1979 | Lumpkin et al. | 431/352 |
| 4,213,402 | 7/1980 | Kochey | 110/171 |

OTHER PUBLICATIONS

Pyrites Conveyors, pp. 2–5, Pyrites Conveyor Bulletin No. 2PY-64 by United Conveyor Corp., Copyright 1964.

*Primary Examiner*—Henry C. Yuen

*Attorney, Agent, or Firm*—William W. Habelt

[57] ABSTRACT

An improved pulverizer rejects disposal system having an air separator disposed in the sluice pipeline to remove any air entrained in the pulverizer rejects/water slurry prior to injection into the bottom ash hopper of a pulverized coal-fired boiler.

3 Claims, 3 Drawing Figures

PULVERIZER REJECTS DISPOSAL

BACKGROUND OF THE INVENTION

The present invention relates to pulverized fuel-fired steam generators and, more particularly, to an improved apparatus for disposing of pyrites and other pulverizer rejects.

Coals found in the United States and presently being fired in pulverized fuel-fired steam generators may contain up to 50 percent non-combustible material termed ash. A portion of this non-combustible material is extremely hard and resists pulverization as the coal is ground to a powder in the pulverizer and swept by an air stream into the furnace to be combusted therein. This portion of non-combustible material which resists pulverization, primarily iron pyrites and tramp iron, is separated from the pulverized coal by screening and rejected from the pulverizer. The remainder of the non-combustible material contained in the raw coal is effectively pulverized and passes to the furnace with the pulverized fuel and typically collects either on the walls of the furnace or on the downstream convection surface as ash deposits.

In a typical dry-bottom pulverized coal-fired steam generator, a water-filled bottom ash hopper is disposed directly below the furnace to collect and hold for subsequent removal ash deposits which break away from the furnace walls during the wall cleaning cycle. Since the bottom ash hopper is a readily accessible storage receptacle, it is considered most economical to the pulverizer rejects to the bottom ash hopper for storage instead of providing an additional separate system for disposing of the pulverizer rejects.

In the typical prior art pulverizer rejects disposal system, rejects from the pulverizer are collected in a small hopper next to the pulverizer. The rejects flowing from the collection hopper are mixed with water and conveyed as a slurry through a sluice pipe by means of a high pressure jet pump and injected into the water-filled bottom ash hopper. Attempts to utilize the bottom ash hopper as a concomitant storage as just described has encountered a major problem which is generally lead to the abandonment of this approach in favor of a separate storage receptacle for the pulverizer rejects themselves. As the water-filled bottom ash hopper is located immediately below the furnace hopper, the waterwall tubes formed in the furnace hopper slope pass over a portion of the bottom ash hopper on their way to lower water-wall inlet headers. Consequently, these tubes, which are near saturation temperature during furnace operation, are exposed to the cool water filling the bottom ash hopper which is typically at a temperature of 140° F. to 160° F.

In order to eliminate the possibility of cool water splashing against the hot waterwall tubes disposed directly above the bottom ash hopper, it was common to inject the pulverizer rejects/water slurry into the bottom ash hopper at a point below the water level therein. However, a major problem arose as a result of air entrained in the slurry when the rejects from the air-swept pulverizer were mixed with the water to form the slurry. The entrained air would bubble violently upward out of the bottom ash hopper thereby carrying cool water onto the hot tubes exposed above the bottom ash hopper. The repeated thermal shock resulting therefrom causes an unacceptable frequency of tube failure in the furnace hopper tubes and leads to the abandonment of the use of the bottom ash hopper as a storage receptacle for pulverizer rejects.

SUMMARY OF THE INVENTION

The present invention provides an improved pulverizer rejects disposal assembly wherein any air entrained in the pulverizer rejects/water slurry is removed prior to injection into the bottom ash hopper, thereby permitting the bottom ash hopper to again be used as a storage receptacle for pulverizer rejects without fear of air bubbles carrying cool water onto the hot tubes of the furnace hopper. Accordingly, the unnecessary duplication of storage equipment for handling the pulverizer rejects is eliminated.

Pulverizer rejects are mixed with water and conveyed to the bottom ash hopper through a sluice pipe by means of a jet pump. In accordance with the invention herein, an air separator for removing entrained air from the slurry is disposed at the discharge end of the sluice pipe, the air separator having an inlet for receiving the slurry from the sluice pipe, an outlet opening into the bottom ash hopper for discharging the air-free pulverizer rejects/water slurry into the bottom ash hopper, and a vent for releasing the air removed from the slurry within the air separator.

In the preferred embodiment, the air separator comprises an elongated, capped top cylinder inclined at an angle with the horizontal and having an inlet located in the sidewall thereof at its upper end for receiving the air laden pulverizer rejects/water slurry so as to form a vortex swirl about the axis of the cylinder, an open bottom opening into the bottom ash hopper at a point below the water level within the bottom ash hopper, and a vent hole in the top thereof for venting the air removed from the slurry by the vortex swirl established within the cylinder.

DESCRIPTION OF THE PREFERRED EMBODIMENT

Figure 1:
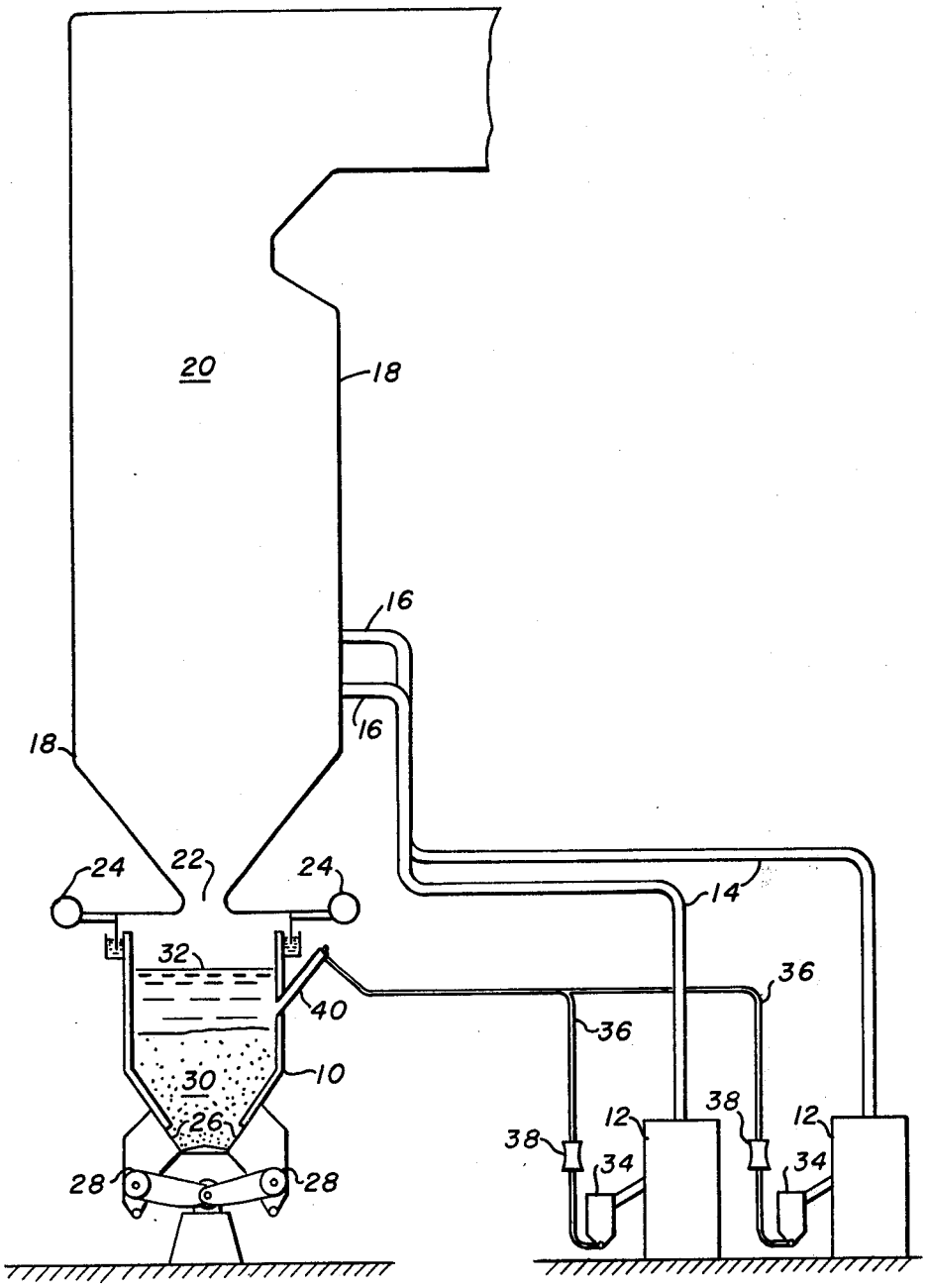
FIG. 1 is a diagrammatic representation of a pulverizer rejects disposal system which may be employed in the practice of the present invention.

The apparatus shown in FIG. 1 constitutes a representative means of disposing of pulverizer rejects in the bottom ash hopper of a pulverizer coal-fired furnace. Furnace 20 is formed of a plurality of parallel vertically extending water-filled tubes 18 disposed laterally adjacent to each other around the perimeter of the furnace to form what is commonly termed the waterwall of the furnace. At the lower end of the furnace 20, the tubes 18 are inclined inwardly towards each other from opposite sides to form an open trough 22 extending across the bottom of the furnace 20. At this point, the tubes are bent outwardly and extend horizontally into inlet headers 24.

Disposed directly beneath the open trough 22 extending across the bottom of the furnace 20 is an ash collection and storage receptacle 10 commonly termed a water-impounded, i.e., filled, bottom ash hopper. The bottom ash hopper 10 has an open top for receiving ash or slag deposits falling off the furnace waterwall tubes 18 and one or more openings 26 at its bottom through which the ash and other material 30 collected in the bottom ash hopper 10 is intermittently removed by any suitable means, such as a motor driven centrifugal pump 28, and transported by pipeline to a disposal pit.

The function of the water-impounded bottom ash hopper 10 is to receive, quench, and storage ash and slag deposits which fall from the furnace waterwall tubes 18 during operation. In order to cool the hot ash falling from the tubes and to protect the wall of the bottom ash hopper 10 from the heat radiating downward from the flame within the furnace 20, the bottom ash hopper 10 is filled with water. In order to insure that there is a sufficient heat sink to properly cool the ash and to protect the bottom ash hopper itself, a normal water level 32 is maintained within the bottom ash hopper 10 and additional cold water is continuously added to maintain the water temperature within the bottom ash hopper 10 within the range of 140° F. to 160° F. To fire the furnace, raw coal is delivered to the pulverizers 12 wherein the raw coal is ground to a fine powder and dried by hot air. The pulverized coal is entrained in the hot air and conveyed through fuel pipes 14 to burner 16 for combustion within the furnace 20. Coal is a heterogeneous material consisting primarily of combustible carbon and volatile matter but also containing a significant amount of non-combustible material termed ash. A portion of this non-combustible material is extremely hard and resists pulverization in the pulverizers 12. This portion of non-combustible, hard-to-grind material, primarily iron pyrites and tramp iron, is separated from the pulverized coal by screening and passed from the pulverizers 12 for collection in the pyrites hopper 34. To dispose of the pulverizer rejects, the rejects are mixed with water and conveyed as a slurry through a sluice pipeline 36 by means of a high pressure jet pump 3 for storage in the bottom ash hopper 10 to await subsequent disposal.

When the pulverizer rejects are withdrawn from the pyrites hopper 34, air is entrained in the pulverizer rejects/water slurry and passed under high pressure along with the slurry through the sluice pipeline 36. As mentioned previously, a major problem has arisen in the past as a result of the high pressure air entrained in the slurry being injected into the bottom ash hopper 10 at a point below the water level 32 within the bottom ash hopper. If the high pressure air were permitted to enter the bottom ash hopper, it would bubble violently upward out of the water thereby causing cool water to be carried onto the hot tubes 18 extending across a portion of the top of the bottom ash hopper 10 and thereby result in an unacceptable frequency of tube failures in this region.

In accordance with the present invention, disposed at the discharge end of the sluice pipe 36 is an air separator for separating air from the slurry, said air separator having an inlet for receiving the slurry from the sluice pipe 36, an outlet opening into the bottom ash hopper 10 at a point below the water level 32 therein for discharging the air-free pulverizer rejects/water slurry into the bottom ash hopper, and a vent for releasing the air removed from the slurry. The air removed from the slurry may be released to the atmosphere or, alternatively, vented back to the furnace 20.

Figure 2:
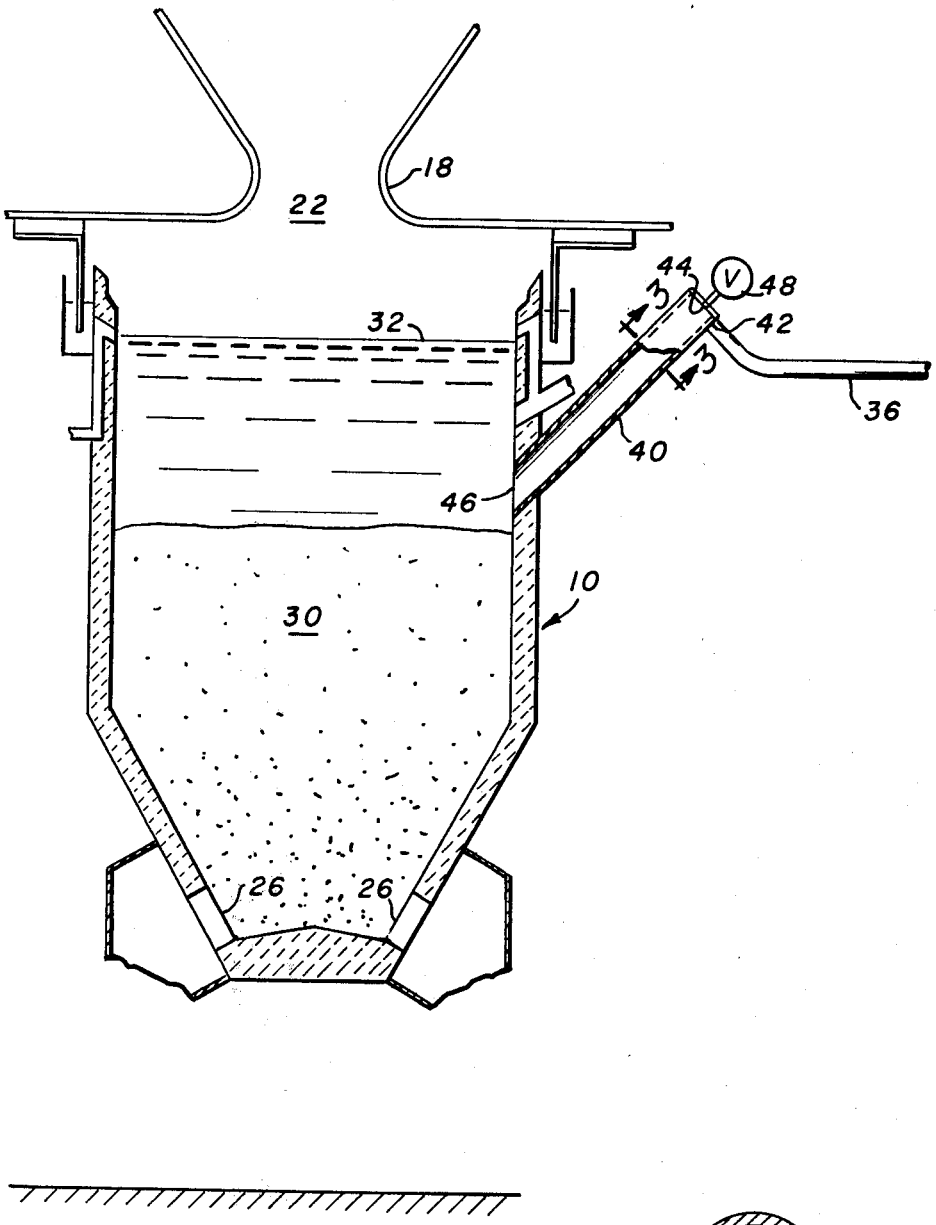
FIG. 2 is a cross-sectional elevational view of the bottom ash hopper region of a furnace equipped with pulverizer rejects disposal system designed in accord with the preferred embodiment of the present invention.
Figure 3:
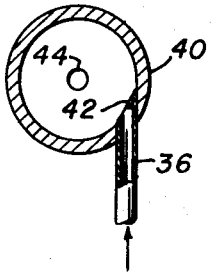
FIG. 3 is a sectional view of the air separator of the preferred embodiment of the present invention taken along line 3—3 of FIG. 2.

In the preferred embodiment, as best shown in FIGS. 2 and 3, said air separator comprises an elongated, capped top cylinder 40 having an inlet 42 in the sidewall thereof for receiving the air-laden pulverizer rejects/water slurry discharging from sluice pipe 36 so as to produce a vortex swirl about the axis of the cylinder 40, a vent hole 44 in the top thereof coaxial with the axis of said cylinder 40 for releasing the separator there, and an open bottom 46 opening into the bottom ash hopper 10 at a point below the water level 32 therein for discharging the air-free pulverizer rejects/water slurry, said cylinder 40 inclined at an angle with the horizontal of preferably approximately 45°.

By circumferentially injecting the air-laden pulverizer rejects/water slurry discharging from sluice pipe 36 into the cylinder 40, a vortex swirl is generated about the axis of the cylinder 40. Due to centrifugal force, the denser material in the slurry, i.e., the pulverizer rejects and water, are thrown outward toward the wall of the cylinder. Conversely, the much less dense air molecules entrained in the slurry migrate inward toward the axis of the cylinder 40. As a result of the high pressure, the air molecules separated from the slurry will migrate up the axis and out the vent hole 44 in the top of the cylinder 40. Because the cylinder 40 is inclined at an angle with the horizontal, the air-free pulverizer/water slurry thrown outward to the wall of the cylinder 40 in the vortex swirl will naturally flow downward under the influence of gravity through the open bottom 48 of the cylinder into the bottom ash hopper 10. Because cylinder 40 opens into the bottom ash hopper 10 at a point below the water level 32 therein, the cylinder 40 itself will fill with water to a level equivalent to that within the bottom ash hopper 10. The presence of this water within the cylinder 40 serves to dampen the velocity with which the pulverizer rejects flow downward through the cylinder to the bottom ash hopper 10 thereby greatly reducing the turbulents generated within the bottom ash hopper when the pulverizer rejects are discharged through the open bottom 46 of the cylinder 40.

In order to sufficiently reduce the velocity of the incoming air-laden slurry so that any air entrained therein will separate out, the diameter of the air separator cylinder 40 should be approximately three times larger than the diameter of the sluice pipe 36. By maintaining such approximate diameter relationship, the velocity of the incoming slurry stream is reduced enough to allow the air entrained therein to migrate to the axis of the cylinder and then out of the top of the cylinder, but not be reduced so much that the vortex swirl is weakened to the point where the pulverizer rejects and water are no longer forced outward along the wall of the cylinder.

As shown in FIG. 2, it is preferable to place a check valve on the vent hole in the top of the air separator cylinder 40. The check valve prevents air from the atmosphere back to the furnace 20 or to the bottom ash hopper 10 at a point above the water level 32 therein, from entering the cylinder in the event that the water level within the bottom ash hopper 10 has been reduced to a point below that at which the cylinder 40 opens into the bottom ash hopper.

It is to be understood that the present invention is not limited to the specific embodiments herein illustrated and described but may be used in other ways without departure from the spirit and scope of the present invention.

What is claimed is:

1. In a pulverized coal-fired steam generator having a furnace formed of a plurality of parallel, vertically extending water-filled tubes, a portion of the tubes being inclined inward towards each other from opposite sides so as to form an open trough extending across the bottom of the furnace, a pulverizer for pulverizing the coal to be fired in the furnace, and a water-filled bottom ash hopper having an open top disposed beneath the furnace so as to receive ash discharging from the furnace through the trough; an improved pulverizer rejects disposal assembly having means for conveying a slurry consisting essentially of pulverizer rejects, water and entrained air through a sluice pipe from the pulverizers to said water-filled bottom ash hopper, and separating means disposed at the discharge end of the sluice pipe for removing entrained air from the slurry prior to the slurry discharging into said water-filled bottom ash hopper, characterized in that said separating means comprises:

an elongated, capped top cylinder having a tangential inlet in the sidewall thereof for receiving the slurry discharging from the sluice pipe so as to produce a vortex swirl about the axis of said cylinder, a vent hole in the top thereof coaxial with the axis of said cylinder for releasing the separated air, and an open bottom opening into said water-filled bottom ash hopper at a point below the water level therein for discharging the air-free slurry therethrough, said cylinder inclined at an angle with the horizontal.

2. An apparatus as recited in claim 1, further comprising a check valve operatively associated with the vent hole in the top of said cylinder to prevent air from flowing into said cylinder.

3. An apparatus as recited in claim 1 or 2 wherein said cylinder is inclined at an angle with the horizontal of approximately 45°.

* * * * *